United States Patent [19]

Hodgson

[11] Patent Number: 4,519,108

[45] Date of Patent: May 28, 1985

[54] COMBINATION TOOL

[76] Inventor: Donald E. Hodgson, 9081 Tahoe, Boulder, Colo. 80301

[21] Appl. No.: 530,511

[22] Filed: Sep. 9, 1983

[51] Int. Cl.[3] ..... B25G 1/08

[52] U.S. Cl. ..... 7/167; 30/151

[58] Field of Search ..... 7/145, 158, 167; 30/151; 145/2 R

[56] References Cited

U.S. PATENT DOCUMENTS

| | | | |
|---|---|---|---|
| 1,028,008 | 5/1912 | Eslick, Jr. | 7/168 |
| 1,176,192 | 3/1916 | Beckton et al. | 30/151 X |
| 1,185,250 | 5/1916 | Seelye | 7/168 |
| 2,005,176 | 6/1935 | Arbuckle | 30/151 X |
| 2,280,463 | 4/1942 | Williamson | 30/142 |
| 2,695,450 | 11/1954 | Platts | 7/167 X |
| 2,721,340 | 10/1955 | Shultz | 7/145 |
| 3,252,489 | 5/1966 | Huston et al. | 7/145 X |
| 3,627,007 | 12/1971 | Rieffer | 145/2 R |
| 4,435,868 | 3/1984 | McQueen | 7/158 |

*Primary Examiner*—James G. Smith

*Attorney, Agent, or Firm*—Sheridan, Ross & McIntosh

[57] ABSTRACT

A combined hatchet and knife are provided wherein the knife is stored in the handle of the hatchet for easy transportation by means which allow the knife to be completely separated from the hatchet when desired.

11 Claims, 6 Drawing Figures

Fig 1
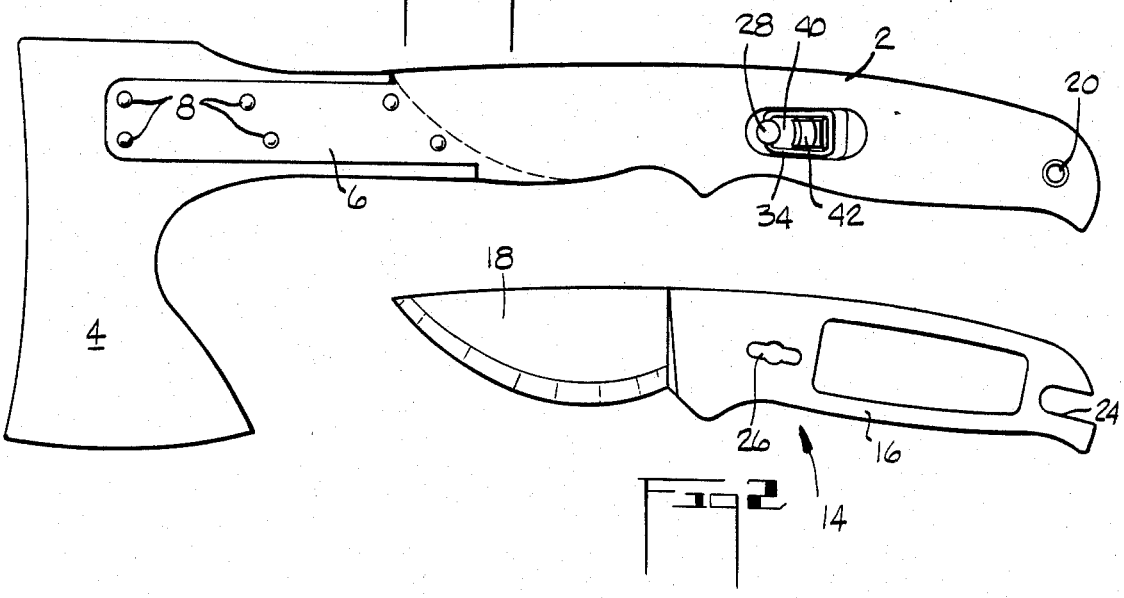
Fig 2
Fig 3
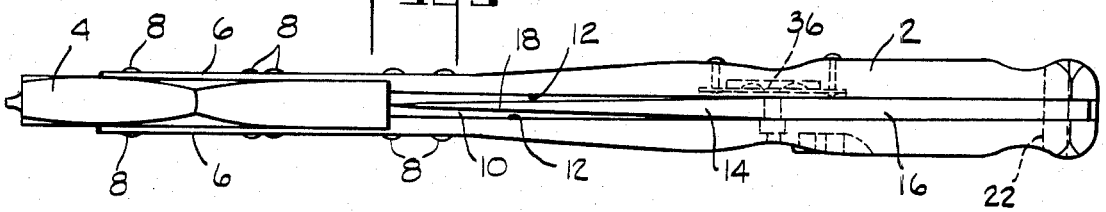
Fig 5
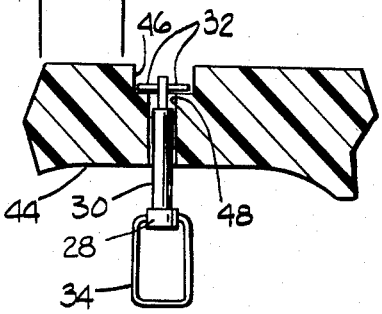
Fig 6
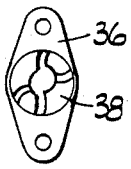
Fig 4
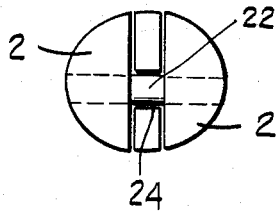

COMBINATION TOOL

FIELD OF THE INVENTION

This invention is directed to tools normally carried by outdoorsmen for use when camping, fishing, hunting or similar types of activity. More specifically, the invention is directed to a combination tool whereby a plurality of tools are combined for easy packing and transporting as a single unit but which may be readily completely separated for independent use when desired.

BACKGROUND OF THE INVENTION

In normal outdoor activities, such as camping, fishing, hunting or the like, it is desirable to have different tools available for different purposes. Two of the more commonly used tools in such activities are a hatchet and a knife. There have been suggestions in the prior art to combine these tools into a single unit. This is disclosed in Rieffer (U.S. Pat. No. 3,627,007); Shultz (U.S. Pat. No. 2,721,340) and Williamson (U.S. Pat. No. 2,280,463). However, in these prior art references, either the knife cannot be removed completely from the hatchet or the handle of the hatchet is shortened when the knife is completely removed. Eslick (U.S. Pat. No. 1,028,008) discloses a knife mounted in a handle of a hatchet so that the knife may be completely removed from the handle, but Eslick requires a sheath for the knife which sheath is not removed from the handle.

BRIEF SUMMARY OF THE INVENTION

This invention relates to a combination tool which in the preferred embodiment comprises a hatchet and a knife wherein the knife is positioned in a cavity in the handle of the hatchet for ready transportation therewith but may be readily and completely removed from the handle when desired. This is accomplished by having a pin secured to the handle with a portion of the pin located in the cavity. The handle of the knife is provided with a cutout adjacent one end thereof which cutout partially surrounds the portion of the pin when the knife is positioned in the cavity. Means are provided for locking the knife in the cavity. In the preferred embodiment, the locking means comprises a quarter turn lock fastener having a shank portion extending through an opening in the handle of the knife.

It is an object of this invention to provide a combination tool wherein a cutting tool may be mounted in the handle of a tool by means which allow for readily removing the cutting tool completely from the handle.

It is another object of this invention to provide a combination tool wherein the useable portions of each tool remain the same when the cutting tool is completely removed from the handle.

These and other objects of the invention will be apparent from the following more particular description of the preferred embodiment as illustrated in the accompanying drawings in which like reference characters refer to the same parts throughout the various views. The drawings are not necessarily to scale, emphasis instead being placed upon illustrating the principles of the invention.

BRIEF DESCRIPTION OF THE DRAWINGS

FIG. 1 is a side elevation of the invention;

FIG. 2 is a side elevation of the knife removed from the handle;

FIG. 3 is a top plan view of FIG. 1;

FIG. 4 is an end view of FIG. 1;

FIG. 5 is a plan view of one portion of the locking means with a portion of the handle in cross section; and FIG. 6 is a plan view of the other portion of the locking means.

DETAILED DESCRIPTION OF THE INVENTION

In FIG. 1, there is illustrated a combination tool having a handle 2. At one end of the handle, a hatchet head 4 is secured thereto by a pair of extensions 6 having rivets 8 extending therethrough. The handle 2 is provided with a cavity 10 defined by the walls 12. A cutting tool 14 having a handle 16 and a blade 18 is mounted in the cavity 10. A pin 20 is secured to the handle 2 and has a portion 22 in the cavity 10. One end of the handle 2 is provided with a cutout 24 which is adapted to partially surround the pin 20 when the cutting tool 14 is mounted in the cavity 10. The handle 16 of the cutting tool 14 is also provided with an opening 26 shaped to allow passage therethrough of the locking means described below.

The locking means is illustrated specifically in FIGS. 5 and 6 and comprises a quarter turn lock fastener having a head 28, a shank 30 and locking bars 32. A ring 34 is secured to the head 28 for assistance in turning or removing the locking means. A plate 36 having projections 38 for receiving the locking bars 32 is mounted in the handle 2. A recess 40 is provided in the handle 2 for receiving the head 28 and the ring 34 which may be folded over a projection 42 in the cavity so as not to interfere with gripping the handle 2 of the hatchet. A portion 44 of the recess 40 is joined to a recess 46 adjacent the cavity by a narrow opening 48 so that the locking means cannot be completely removed from the handle 2.

The cutting tool 14 is mounted in the cavity 10 by inserting the end of the cutting tool having the cutout 24 into the cavity 10 so that the cutout 24 partially surrounds the portion 22 of the pin 20. The cutting tool is then rotated about the pin 20 until it is fully within the cavity 22. The locking bars 32 are then passed through the opening 26 in the handle 16 and through the plate 36. The ring 34 is then used to turn the locking bars 32 one quarter of a turn into a position secured by the projections 38. When it is desired to remove the cutting tool 14, the foregoing procedure is reversed.

While the preferred embodiments of the invention have been described herein, it may be otherwise embodied and practiced within the scope of the following claims.

What is claimed is:

1. A tool comprising:

a handle;

a head attached to one end of said handle, said head extending in a direction generally perpendicular to the longitudinal axis of said handle;

said head having tool means formed thereon;

a longitudinally extending cavity in said handle;

support means located in said handle adjacent the other end thereof with a portion of said means located in said cavity;

a cutting tool;

means for mounting said cutting tool in said cavity, said means also allowing said cutting means to be completely removed from said cavity and said handle;

said means comprising a cutout adjacent one end of said cutting tool, said cutout cooperating with said portion of said support means in said cavity to support said cutting tool when said cutting tool is mounted in said cavity;

said support means and said cutout cooperating to form means for permitting pivotal movement of said cutting tool into or out of said cavity; and means for locking said cutting tool in position in said cavity.

2. A tool as in claim 1 wherein said support means having a portion in said cavity comprises:

a pin extending through said handle.

3. A tool as in claim 2 wherein:

said cutout in said tool partially surrounds said portion of said pin located in said cavity.

4. A tool as in claim 3 wherein said cutting tool comprises:

a handle having said cutout at said one end thereof; and a cutting blade secured to the other end of said handle.

5. A tool comprising:

a handle;

a head attached to one end of said handle, said head extending in a direction generally perpendicular to the longitudinal axis of said handle;

said head having tool means formed thereon;

a longitudinally extending cavity in said handle;

support means located in said handle adjacent the other end thereof with a portion of said means located in said cavity;

said support means comprising a pin extending through said handle;

a cutting tool;

means for mounting said cutting tool in said cavity, said means also allowing said cutting means to be completely removed from said cavity and said handle;

said means comprising a cutout adjacent one end of said cutting took, said cutout cooperating with said portion of said support means in said cavity to support said cutting tool when said cutting tool is mounted in said cavity;

said cutout in said cutting tool partially surrounding said portion of said pin located in said cavity;

said cutting tool comprising a handle having said cutout at said one end thereof and a cutting blade secured to the other end of said handle;

means for locking said cutting tool in position in said cavity;

said locking means comprising:

an opening in said cutting tool;

means having a shank portion extending through said opening; and means for securing said means having a shank portion to said handle.

6. A tool as in claim 5 wherein said means having a shank portion comprises:

a quarter turn lock fastener.

7. A tool as in claim 5 wherein said securing means comprises:

a plurality of bars extending substantially perpendicularly from said shank portion adjacent one end thereof; and a ring attached to said shank portion adjacent the other end thereof.

8. A tool as in claim 7 and further comprising:

means in said handle preventing complete removal of said locking means from said handle.

9. A tool as in claim 8 wherein said means for preventing complete removal comprises:

a first recess in the outer surface of said handle;

a second recess in the surface of said handle adjacent said cavity;

an open passageway connecting said first and second recesses; and said passageway being of a size to receive said shank portion but to prevent movement therethrough of said bars or said ring.

10. A tool as in claim 9 and further comprising:

a projection out of said first recess so that said ring may be folded around said projection and be located in said recess.

11. A tool as in claim 10 wherein said head comprises:

a hatchet.

* * * * *